US007483663B2

(12) United States Patent
Ide et al.

(10) Patent No.: US 7,483,663 B2
(45) Date of Patent: Jan. 27, 2009

(54) FIXING APPARATUS HAVING A CLEANING MEMBER AND IMAGE FORMING APPARATUS HAVING THE SAME

(75) Inventors: Atsushi Ide, Nara (JP); Hiroaki Hori, Kyoto (JP)

(73) Assignee: Sharp Kabushiki Kaisha, Osaka (JP)

( * ) Notice: Subject to any disclaimer, the term of this patent is extended or adjusted under 35 U.S.C. 154(b) by 305 days.

(21) Appl. No.: 11/199,339

(22) Filed: Aug. 8, 2005

(65) Prior Publication Data

US 2006/0029441 A1 Feb. 9, 2006

(30) Foreign Application Priority Data

Aug. 9, 2004 (JP) ..... 2004-232603

(51) Int. Cl.
*G03G 15/20* (2006.01)

(52) U.S. Cl. ..... 399/327

(58) Field of Classification Search ..... 399/326, 399/327, 45, 325; 219/216; 118/60; 101/425; 15/256.51, 256.52
See application file for complete search history.

(56) References Cited

U.S. PATENT DOCUMENTS

| | | | | |
|---|---|---|---|---|
| 4,013,400 | A * | 3/1977 | Thettu et al. | 399/327 |
| 5,452,065 | A * | 9/1995 | Bell | 399/325 |
| 5,636,012 | A * | 6/1997 | Uneme et al. | 399/325 |
| 5,649,130 | A * | 7/1997 | Nakajima et al. | 399/327 |
| 5,699,584 | A * | 12/1997 | Wieloch et al. | 15/256.52 |
| 5,930,574 | A * | 7/1999 | Segawa | 399/327 |
| 6,434,358 | B1 * | 8/2002 | Maul et al. | 399/325 |
| 2006/0072945 | A1 * | 4/2006 | Ide | 399/327 |

FOREIGN PATENT DOCUMENTS

| | | | |
|---|---|---|---|
| JP | 01265284 | A * | 10/1989 |
| JP | 03242670 | A * | 10/1991 |
| JP | 03287286 | A * | 12/1991 |
| JP | 04022982 | A * | 1/1992 |
| JP | 05204274 | A * | 8/1993 |
| JP | 09080957 | A * | 3/1997 |
| JP | 2000029351 | A * | 1/2000 |
| JP | 2000-214717 | | 8/2000 |
| JP | 2001100583 | A * | 4/2001 |
| JP | 2001215838 | A * | 8/2001 |
| JP | 2002189373 | A * | 7/2002 |
| JP | 20022244474 | A * | 8/2002 |
| JP | 2002311739 | A * | 10/2002 |
| JP | 2003-107952 | | 4/2003 |
| JP | 2003233265 | A * | 8/2003 |

* cited by examiner

*Primary Examiner*—Robert Beatty
(74) *Attorney, Agent, or Firm*—Renner, Otto, Boisselle & Sklar, LLP

(57) ABSTRACT

In a fixing apparatus that an unfixed developer is fused and fixed by heating/pressurizing a recording medium on which an image of the unfixed developer is formed, a belt-shaped cleaning member is fed from a feeding roller, and the cleaning member is made to respectively contact a heating roller and a pressure roller by a pressure-contact roller, thereby cleaning that the heating roller and the pressure roller, respectively. When a winding roller takes up the cleaning member which has cleaned a roller surface, guide rollers are respectively provided between the pressure-contact roller and the winding roller, and between the feeding roller and the pressure-contact roller so as to contact the cleaning member.

9 Claims, 10 Drawing Sheets

FIG. 6

| TYPES OF SHEET | PRINT RATIO | ROTATION CYCLE OF WINDING ROLLER (ONE TIME/NUMBR OF PRINTING SHEETS) | CONVERSION RATE TO A4 WIDTHWISE |
|---|---|---|---|
| A3 | 5% OR LESS | 10 SHEETS | X 2.00 |
| | 5 TO 8% | 7 SHEETS | |
| | 8 TO 12% | 5 SHEETS | |
| | 12% OR MORE | 3 SHEETS | |
| B4 | 5% OR LESS | 10 SHEETS | X 2.00 |
| | 5 TO 8% | 7 SHEETS | |
| | 8 TO 12% | 5 SHEETS | |
| | 12% OR MORE | 3 SHEETS | |
| A4 LENGTHWISE CONVEYANCE | 5% OR LESS | 15 SHEETS | X 1.33 |
| | 5 TO 8% | 10 SHEETS | |
| | 8 TO 12% | 7 SHEETS | |
| | 12% OR MORE | 5 SHEETS | |
| A4 WIDTHWISE CONVEYANCE | 5% OR LESS | 20 SHEETS | X 1.00 |
| | 5 TO 8% | 15 SHEETS | |
| | 8 TO 12% | 10 SHEETS | |
| | 12% OR MORE | 6 SHEETS | |
| B5/SMALL SIZE SHEET SUCH AS POSTCARD | 5% OR LESS | 30 SHEETS | X 0.67 |
| | 5 TO 8% | 20 SHEETS | |
| | 8 TO 12% | 15 SHEETS | |
| | 12% OR MORE | 10 SHEETS | |

FIG. 7

| TYPES OF SHEET | PRINT RATIO | ROTATION CYCLE OF WINDING ROLLER (ONE TIME/NUMBR OF PRINTING SHEETS) | CONVERSION RATE TO A4 WIDTHWISE AND PRINT RATIO OF 5% OR LESS |
|---|---|---|---|
| A4 WIDTHWISE CONVEYANCE | 5% OR LESS | 20 SHEETS | X 1.00 |
| | 5 TO 8% | 15 SHEETS | X 1.33 |
| | 8 TO 12% | 10 SHEETS | X 2.00 |
| | 12% OR MORE | 6 SHEETS | X 3.33 |

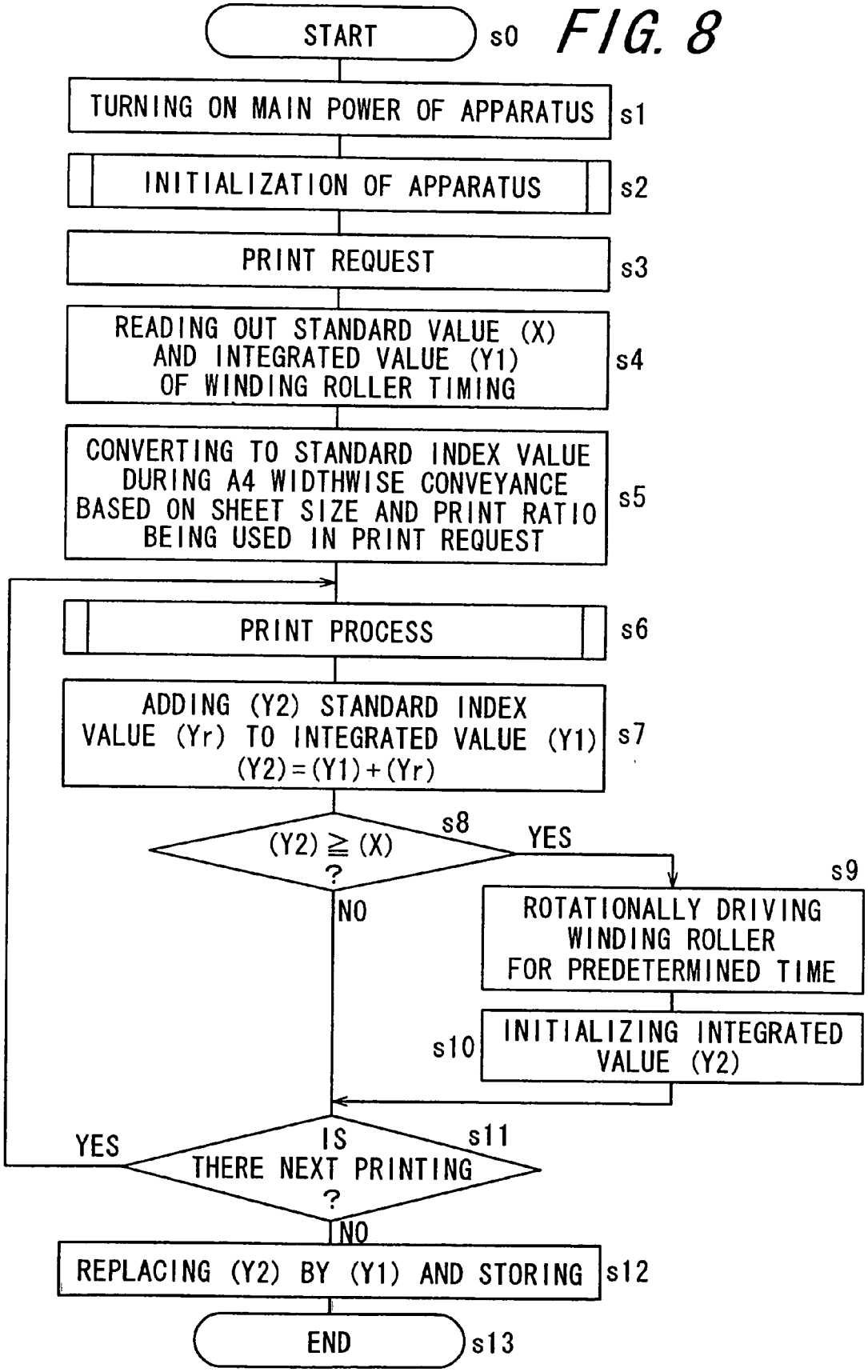
FIG. 8
START
s0
TURNING ON MAIN POWER OF APPARATUS
s1
INITIALIZATION OF APPARATUS
s2
PRINT REQUEST
s3
READING OUT STANDARD VALUE (X) AND INTEGRATED VALUE (Y1) OF WINDING ROLLER TIMING
s4
CONVERTING TO STANDARD INDEX VALUE DURING A4 WIDTHWISE CONVEYANCE BASED ON SHEET SIZE AND PRINT RATIO BEING USED IN PRINT REQUEST
s5
PRINT PROCESS
s6
ADDING (Y2) STANDARD INDEX VALUE (Yr) TO INTEGRATED VALUE (Y1) (Y2)=(Y1)+(Yr)
s7
(Y2) ≧ (X) ?
s8
YES
NO
ROTATIONALLY DRIVING WINDING ROLLER FOR PREDETERMINED TIME
s9
INITIALIZING INTEGRATED VALUE (Y2)
s10
IS THERE NEXT PRINTING ?
s11
YES
NO
REPLACING (Y2) BY (Y1) AND STORING
s12
END
s13

FIXING APPARATUS HAVING A CLEANING MEMBER AND IMAGE FORMING APPARATUS HAVING THE SAME

BACKGROUND OF THE INVENTION

1. Field of the Invention

The present invention relates to a fixing apparatus favorably for use in an electrophotographic image forming apparatus, and to an image forming apparatus having the same.

2. Description of the Related Art

In an image formation using an electrophotographic system, a photoreceptor charged with a uniform electric potential is exposed to light in accordance with image information so that an electrostatic latent image is formed. The formed electrostatic latent image is developed by a developer so as to be visualized. The visualized image is transferred on a recording paper or the like, and the transferred developer on the recording paper is made to be fixed so as to form a solid recording image.

The fixing apparatus used for such image formation, is generally composed of a heating roller and a pressure roller, which are such configured that in passing the recording paper on which the developer for forming a visualized image through a pressure contact region (hereinafter referred to as a nip section) of the heating roller and the pressure roller which is formed by pressing the pressure roller against the heating roller, unfixed developer is fused and fixed by heating of the heating roller and pressing of the pressure roller.

During a fixing operation in the fixing apparatus, there sometimes occurs a so-called hot offset that the developer fused on the nip section of the both rollers is not all fixed on the recording paper, but a part of the developer is attached to a surface of the roller. For instance, the developer attached to the heating roller is transferred on a portion which should be properly a white base, on a recording paper on which the developer is to be subsequently fixed, with the result that an image defect is made to occur.

Moreover, on the pressure roller, the developer which has already fixed to a back surface of the conveyed recording paper, for instance as in a case of duplex print, is sometimes fused again by heat in passing through the nip section and a part of the developer is transferred and attached to the pressure roller. The developer thus attached to the pressure roller may cause the image defect and further, may cause a soil of the back surface of the recording paper.

The image defect caused by the hot offset in the fixing apparatus sometimes remains, in a case of black-and-white print, mere defects such as a fog in a white base of the formed image, a soil on the back surface of the recording paper, or the like in a tolerable range. However, in a case of full-color print, since a developer having a color different from a prescribed one is transferred from the both rollers, there often occur practically intolerable defects.

As a related art for solving such a problem, there is an apparatus having roller cleaning means on the both rollers provided in a fixing apparatus (refer to Japanese Unexamined Patent Publication JP-A 2003-107952).

FIG. 9 is a schematic view showing a configuration of roller cleaning means 1 provided in a related art fixing apparatus. FIGS. 10A to 10C are views for explaining a general outline of operation of the roller cleaning means 1 shown in FIG. 9. FIG. 9 illustrates the roller cleaning means 1 provided on a heating roller 2 in the fixing apparatus.

The roller cleaning means 1 comprises a feeding roller 4 for feeding a belt-shaped cleaning member 3 which has been previously rolled up, a winding roller 5 for taking up the cleaning member 3 fed from the feeding roller 4, and a pressure-contact roller 6 (also referred to as a web pressure-contact roller) provided between the feeding roller 4 and the winding roller 5 so as to press the cleaning member 3 on the heating roller 2.

The roller cleaning means 1 presses the cleaning member 3 on the heating roller 2 which is rotated in an arrow sign 7 direction in a state where the winding roller 5, the feeding roller 4, and the pressure-contact roller 6 are made to be at rest without being rotated so that the heating roller 2 and the cleaning member 3 are made to be slidingly scrubbed. By so doing, a developer 8*a* attached in a fused state to an outer circumferential surface of the heating roller 2 is removed and the removed developer 8*b* is accumulated, still in a substantially fused state, in a gap formed by the cleaning member 3 located between the pressure-contact roller 6 and the winding roller 5, and the surface of the heating roller 2.

When the developer 8*b* accumulated in the gap reaches a certain amount level, the roller cleaning means 1 operates the winding roller 5 for take-up in an arrow sign 9 direction so as to take up the cleaning member 3 only by a predetermined length, with the result that the developer 8*b* is made to detach from the surface of the heating roller 2 in a state where the developer 8*b* is attached to the cleaning member 3.

Hereinafter, an operation of the roller cleaning means 1 in the related art will be further described with reference to FIGS. 10A to 10C. FIG. 10A shows a state where the above-described winding and feeding rollers 4, 5 and the pressure-contact roller 6 are in a rest state, and the developer 8*a* on the surface of the heating roller 2 is removed by the cleaning member 3 and accumulated in the gap between the cleaning member 3 and the surface of the heating roller 2.

FIG. 10B shows a state where an amount of the developer 8*b* accumulated in the gap reaches a certain level, and the winding roller 5 is made to be rotated so as to start taking-up of the cleaning member 3. When the cleaning member 3 is taken up in an arrow sign 10 direction by driving the winding roller 5, the pressure-contact roller 6 is also rotated by frictional force acting between the pressure-contact roller 6 and the to-be-taken-up cleaning member 3. When the pressure-contact roller 6 is rotationally activated, attributable to actions such as the frictional force between the pressure-contact roller 6 and the cleaning member 3, and adhesion of the fused developer 8*b* impregnated in a minute air gap of the cleaning member 3 formed by, for instance, Nomex paper (trade name), there sometimes arises a phenomenon that the cleaning member 3 moves as being attached to the pressure-contact roller 6, namely that the cleaning member 3 is taken up by the pressure-contact roller 6.

FIG. 10C shows a state where the winding roller 5 has further rotated so that a taken-up tension in the arrow sign 10 direction for the cleaning member 3 has further increased. When the taken-up tension further increases and force acting in a direction moving away from an outer circumferential surface of the pressure-contact roller 6 for the cleaning member 3 exceeds an adherence of the cleaning member 3 to the pressure-contact roller 6, the cleaning member 3 is rapidly detached from the surface of the pressure-contact roller 6. By so doing, the cleaning member 3 pulsates in a direction perpendicular to a taken-up direction 10 and in a direction moving close to and away from the surface of the heating roller 2 (an arrow sign 12 direction). Since force generated by pulsation of the cleaning member 3 acts the developer 8*b* in a fused state, attached to the cleaning member 3, the developer 8*b* is dispersed and attached again to the surface of the heating roller 2.

Consequently, in the roller cleaning means 1 of the related art, there arises a problem that a valuable cleaning effect diminishes since the developer 8*b* removed from the surface of the heating roller 2 by the cleaning member 3 is attached again to the heating roller 2 by the pulsation of the cleaning member 3 at the time of starting the taking-up operation for taking up the cleaning member 3.

Moreover, in a cleaning method using such a cleaning member 3 in the related art, it is required to replace a portion of the cleaning member 3 used for cleaning when the developer 8*b* has been accumulated to a certain extent in the gap between the cleaning member 3 and the surface of the heating roller 2, in other words when the cleaning member 3 is soiled by the developer 8*b*. There arises another problem that a time for replacement is not made clear in the related art in spite of a fact that its cycle for replacement varies depending on a print image density, a print image size, or the like.

SUMMARY OF THE INVENTION

An object of the invention is to provide a fixing apparatus capable of giving an excellent cleaning performance by making a take-up operation of a cleaning member smooth when cleaning is performed by making a belt-shaped cleaning member contact a fixing roller (a heating roller or a pressure roller), and an image forming apparatus having the fixing apparatus.

The invention provides a fixing apparatus for fusing and fixing an unfixed developer onto a recording medium, comprising:

fixing rollers which form a pair of rotators, a recording medium on which an image of an unfixed developer is formed being passed through a pressure contact section formed by the fixing rollers;

a belt-shaped cleaning member provided so as to contact at least either one of fixing rollers, for cleaning a surface of the fixing roller;

a pressure-contact roller provided so as to press the cleaning member on the fixing roller which is in contact with the cleaning member;

a feeding roller for feeding the belt-shaped cleaning member which has been previously rolled up;

a winding roller for taking up the cleaning member which has been fed from the feeding roller and cleaned the surface of the fixing roller; and guide rollers provided between the pressure-contact roller and the winding roller so as to contact the cleaning member.

Further, in the invention, it is preferable that the guide rollers are provided between the pressure-contact roller and the winding roller, and between the feeding roller and the pressure-contact roller, respectively, so as to contact the cleaning member.

According to the invention, the configuration is such that, in addition to the belt-shaped cleaning member provided so as to contact at least either one of the fixing rollers, for cleaning the surface of the fixing roller; the pressure-contact roller provided so as to press the cleaning member on the fixing roller; the feeding roller for feeding the cleaning member; and the winding roller for taking up the cleaning member which has been fed from the feeding roller and cleaned the surface of the fixing roller, guide rollers are provided between the pressure-contact roller and the winding roller so as to contact the cleaning member, preferably between the pressure-contact roller and the winding roller, and between the feeding roller and the pressure-contact roller, respectively.

This makes it possible to add appropriate tension to the cleaning member, and therefore, even at a time of starting the take-up operation, the cleaning member is made not to be attached to the pressure-contact roller, with the result that there occurs no pulsation or the like, and the take-up operation can be smoothly carried out. Accordingly, the developer removed by the cleaning member is prevented from being detached from the cleaning member and attached again to the fixing roller at a time of starting the take-up operation so that an excellent cleaning performance is obtained.

Further, in the invention, it is preferable that the cleaning member is provided so as to extend in a tangential direction with respect to an outer circumferential surface of the fixing roller which is in contact therewith.

Further, according to the invention, since the cleaning member is provided so as to extend in the tangential direction with respect to the outer circumferential surface of the fixing roller which is in contact therewith, a stability of the tension added to the cleaning member is enhanced, and vibration of the cleaning member during the take-up operation is further suppressed.

Further, in the invention, it is preferable that the guide roller has a portion made of metal which contacts at least the cleaning member.

Further, according to the invention, since the guide roller has a portion made of metal having excellent heat conductance which portion contacts at least the cleaning member, it is possible to draw heat from a developer in a fused or softened state, which is attached to the to-be-taken-up cleaning member by a heat transfer to the guide roller when the cleaning member passes as being in contact with the guide roller so that the developer can be easily solidified.

Further, in the invention, it is preferable that the fixing apparatus further comprises developer removing means for removing a developer existent on a surface of the to-be-taken-up cleaning member provided on a periphery of the winding roller.

Further, according to the invention, the fixing apparatus comprises the developer removing means for removing the developer existent on the surface of the to-be-taken-up cleaning member provided on the periphery of the winding roller. The developer attached to the to-be-taken-up cleaning member is removed for cleaning by the developing removing means. By so doing, the cleaning member itself can be made in a clean state and therefore, it is made possible to repeatedly use the cleaning member.

Furthermore, in a case where the developer attached to the cleaning member to be taken up by the winding roller is not removed, the cleaning member is taken up with the developer attached thereto and therefore, a taken-up shape of the to-be-taken-up cleaning member becomes irregular and a taken-up diameter varies depending on an attached amount of the developer. However, by removing for cleaning the to-be-attached developer from the cleaning member to be taken up by the winding roller as in the invention, a taken-up shape of the to-be-taken-up cleaning member can be made into a precise cylindrical shape and it is made possible to easily obtain the taken-up diameter based on a take-up speed and a thickness of the cleaning member, and therefore a rotational speed control of the winding roller and the feeding roller can be made easy.

Further, in the invention, it is preferable that the winding roller and the feeding roller can be rotated in both forward and reverse directions.

Further, according to the invention, the winding roller and the feeding roller are configured so as to be capable of being rotated in both the forward and reverse directions and therefore, the winding roller which has been rotated in the forward direction and taken up all the cleaning member, can be reversibly rotated so as to function as a feeding roller and moreover, the feeding roller which has been rotated in the forward direction and fed all the cleaning member, can be reversibly rotated so as to function as a winding roller. By so doing, it is made possible to repeatedly use the cleaning member, with the result that an exchange frequency of the cleaning member can be reduced so as to decrease an intricacy of the operation, and a running cost can be reduced.

Further, in the invention, it is preferable that the winding roller is intermittently rotated, and a distance in a circumferential direction in which the winding roller rotationally moves at one occasion, is equal to or longer than a circumference-wise distance of the pressure contact region formed by pressing the pressure-contact roller on at least either one of fixing rollers.

Further, according to the invention, the winding roller is intermittently rotated, and the distance in the circumferential direction in which the winding roller rotationally moves at one occasion, is equal to or longer than the circumference-wise distance of the pressure-contact region formed by pressing the pressure-contact roller on the fixing roller. When the cleaning member to be used for cleaning the fixing roller is intermittently taken up, it is preferable that an unused portion of the cleaning member be reliably fed to the pressure contact region as a portion to be newly in contact with the fixing roller, of the cleaning member which has been taken up. As a sufficiently reliable taken-up distance, for instance, a distance between the two guide rollers can be thought of, in a case where one guide roller is provided between the pressure-contact roller and the winding roller, and another guide roller between the pressure-contact roller and the feeding roller, respectively. However, in this case, when the taken-up distance is made to be unnecessarily long at one occasion, the cleaning member is consumed in vain and therefore, this becomes a cause of increasing the running cost. Consequently, in the invention, a minimum distance for feeding the clean cleaning member is set equal to or longer than the circumference-wise distance of the pressure contact region.

Further, the invention provides an image forming apparatus for forming a print image in electrophotography, comprising the fixing apparatus.

Further, according to the invention, the fixing apparatus is provided and therefore, there can be realized an image forming apparatus for forming an image without causing an image defect due to a hot offset.

Further, in the invention it is preferable that the image forming apparatus further comprises:

print ratio detecting means for detecting print ratio of a to-be-formed print image;

size detecting means for detecting a size of the recording medium on which the print image is recorded; and rotary launch control means for responding to detected outputs of the print ratio detecting means and the size detecting means, and for controlling a timing of starting a rotary operation of intermittent rotation of the winding roller and feeding roller of the fixing apparatus.

According to the invention, in response to the detected outputs of the print ratio detecting means and the size detecting means, the rotary launch control means controls a timing of starting the rotary operation of intermittent rotation of the winding roller and feeding roller of the fixing apparatus. Consequently, a portion of the cleaning means to be used for cleaning can be replaced by a clean portion thereof at an optimal timing.

Further, in the invention, it is preferable that an intermittent time of the intermittent rotation becomes shorter along with increasing print ratio or increasing size of the recording medium.

Further, according to the invention, the intermittent times of the intermittent rotation of the winding roller and the feeding roller become shorter along with increasing print ratio of the image or increasing size of the recording medium. Consequently, the portion of the cleaning member to be used for cleaning is replaced by the clean portion before the portion of the cleaning member to be used for cleaning is excessively soiled, so that it is possible to form an image without causing an image defect attributable to fixing.

BRIEF DESCRIPTION OF THE DRAWINGS

Other and further objects, features, and advantages of the invention will be more explicit from the following detailed description taken with reference to the drawings wherein:

FIG. 6 is a view illustrating a table data for converting a size of a recording paper and a print ratio to a standard index value;

FIG. 7 is a view illustrating a table data for converting a size of a recording paper and a print ratio to a standard index value;

FIG. 8 is a flow chart for explaining a take-up operation of a cleaning member;

DETAILED DESCRIPTION OF THE PREFERED EMBODIMENTS

Figure 1:
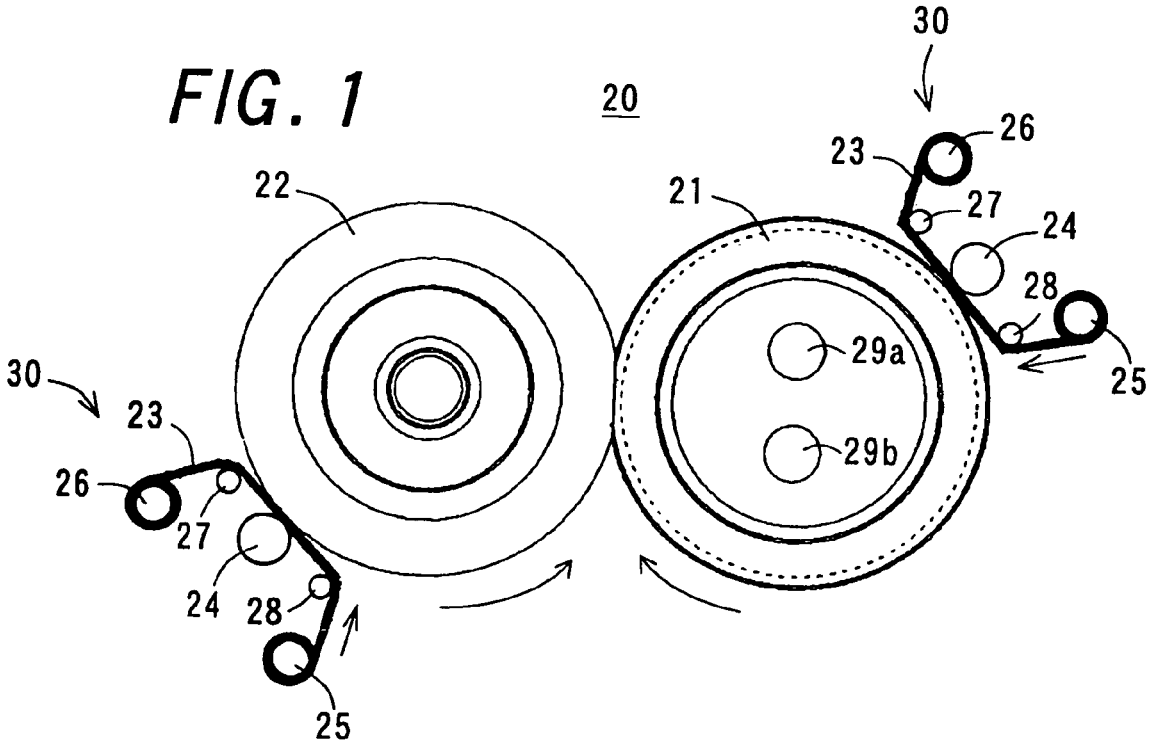
FIG. 1 is a schematic view showing a configuration of a fixing apparatus according to a first embodiment of the invention.

Now referring to the drawings, preferred embodiments of the invention are described below.

Figure 2:
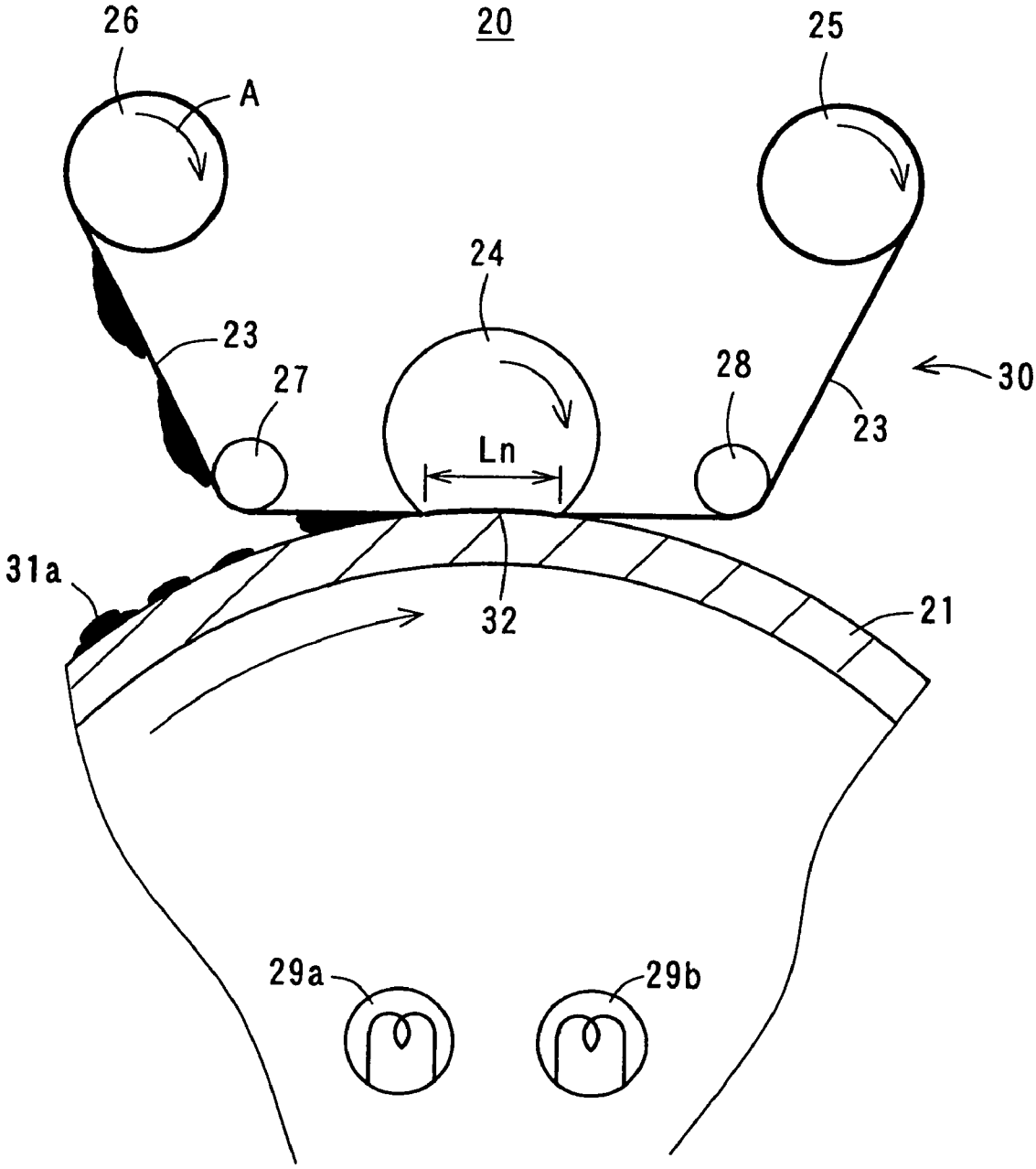
FIG. 2 is an enlarged view of the fixing apparatus shown in FIG. 1 in the vicinity of a heating roller.

FIG. 1 is a schematic view showing a configuration of a fixing apparatus 20 according to one embodiment of the invention. FIG. 2 is an enlarged view of the fixing apparatus 20 shown in FIG. 1 in the vicinity of a heating roller 21.

The fixing apparatus 20 comprises a heating roller 21, a pressure roller 22, a belt-shaped cleaning member 23, a pressure-contact roller 24, a feeding roller 25, a winding roller 26, a first guide roller 27, and a second guide roller 28. The heating roller 21 and the pressure roller 22 are formed by a pair of rotators, and constitute fixing rollers. The belt-shaped cleaning member 23 is provided so as to contact the heating roller 21 and the pressure roller 22, respectively, and cleans surfaces of the fixing rollers. The pressure-contact roller 24 is provided so as to press the cleaning member 23 on the fixing roller which is in contact with the cleaning member 23, and provided so as to be rotatable. The feeding roller 25 feeds the belt-shaped cleaning member 23 which has been previously rolled up in a coil shape or a roll shape. The winding roller 26 takes up the cleaning member 23 which has been fed from the feeding roller 25 and cleaned the roller surface. The first guide roller 27 is provided between the pressure-contact roller 24 and the winding roller 26 so as to contact the cleaning member 23. The second guide roller 28 is provided between the feeding roller 25 and the pressure-contact roller 24 so as to contact the cleaning member 23.

The fixing apparatus 20 is provided with various units which are similar to those provided in a heretofore known fixing apparatus. These portions include, although not shown here, a heater control power source for supplying electric power to heating heaters 29*a* and 29*b* serving as heat sources provided in the heating roller 21; a temperature sensor for detecting a temperature of the heating roller 21; pressing means for pressing the pressure roller 22 on the heating roller 21; and driving means for rotationally driving the heating roller 21 and the pressure roller 22.

The fixing apparatus 20 is mounted, for instance, in an electrophotographic image forming apparatus. In this case, the fixing apparatus 20 is used for fixing that the unfixed developer is fused and fixed onto the recording medium by passing the recording medium on which an image of an unfixed developer is formed, through a nip section formed by the heating roller 21 and the pressure roller 22.

Among all portions constituting the aforementioned fixing apparatus 20, the cleaning member 23, the feeding roller 25, the pressure-contact roller 24, the winding roller 26, and the first and second guide rollers 27 and 28 constitute fixing roller cleaning means 30 for cleaning away a developer attached to a surface of the fixing roller.

In the fixing apparatus 20 according to the embodiment, the fixing roller cleaning means 30 are provided on both the heating roller 21-side and the pressure roller 22-side. Since the heating roller 21 and the pressure roller 22 have the same configuration, the fixing roller cleaning means 30 provided on the heating roller 21-side will be described as a representative example of the configuration so as to omit a description of the fixing roller cleaning means 30 on the pressure roller 22-side.

The cleaning member 23 is a long belt-shaped windable and unwindable member. The cleaning member 23 has such a configuration that a developer 31*a* attached in a fused state to a surface of the heating roller 21 can be entered into an air layer and/or an air gap which are minute spaces, that is, the developer 31*a* can be impregnated (absorbed) into the cleaning member 23. A material having heat resistance in a temperature of approximately 200° C. which is a fixing temperature, is used for the cleaning member 23, and for instance, Nomex paper (trade name) is preferable.

The pressure-contact roller 24 has at least an outermost layer formed of an elastic material having heat resistance so as to be transformed to some extent when pressed on the heating roller 21 and form a pressure contact region 32 (hereinafter, the pressure contact region is also referred to as a nip section 32) between the heating roller 21 and the pressure-contact roller 24. The pressure-contact roller 24 is provided so that an axial line thereof is made to be parallel to an axial line of the heating roller 21, and the cleaning member 23 interposed between the heating roller 21 and the pressure-contact roller 24 is pressed on the surface of the heating roller 21 by the pressing means (not shown).

The feeding roller 25 is a member in a reel form. Around the feeding roller 25 is rolled up the cleaning member 23 having a predetermined length. The feeding roller 25 is connected to a feeding roller driving portion (not shown), and due to the feeding roller driving portion, configured so as to be capable of being reversibly rotated, in other words, be capable of being rotated in both the forward and reverse directions, and controlling a rotational speed thereof. The winding roller 26 is a member in a reel form of the same sort of the feeding roller 25, and takes up the cleaning member 23 which has been fed from the feeding roller 25 so as to be pressed on the heating roller 21 by the pressure-contact roller 24, and then cleaned the developer 31*a*. The winding roller 26 is also connected to a winding roller driving portion (not shown) and due to the winding roller driving portion, configured so as to be capable of being reversibly rotated, in other words, be capable of being rotated in both the forward and reverse directions, and controlling a rotational speed thereof.

It is preferred that the first and second guide rollers 27 and 28 are rollers made of metal having excellent heat conductance such as iron alloy, aluminum, aluminum base alloy, copper, and copper base alloy. This is because it is possible to draw heat from the developer 31*b* in a fused or softened state, which is attached to the cleaning member 23 by a heat transfer to the first and second guide rollers 27 and 28 when the cleaning member 23 that has cleaned the surface of the heating roller 21 passes as being in contact with the guide rollers so that the developer 31*b* can be easily solidified since the first and second guide rollers 27 and 28 are made of metal having excellent heat conductance.

The first and second guide rollers 27 and 28 are disposed at such a position where the cleaning member 23 stretched between the pressure-contact roller 24 and the winding roller 26 and also between the pressure-contact roller 24 and the feeding roller 25 can be further stretched out. Preferably, the first and second guide rollers 27 and 28 are disposed at such a position that, in a cross section perpendicular to the axial line of the heating roller 21, a straight line formed by the cleaning member 23 stretched between the first guide roller 27 and the second guide roller 28 extends in a tangential direction with respect to an outer circumferential surface of the heating roller 21.

By thus disposing the first and second guide rollers 27 and 28 so that the cleaning member 23 extends in the tangential direction of the heating roller 21, tension added to the cleaning member 23 has an enhanced stability, with the result that vibration of the cleaning member 23 during the take-up operation is further suppressed.

An operation of the fixing roller cleaning means 30 will be simply described hereinafter. The cleaning member 23 is fed from the feeding roller 25 and stretched over the second guide roller 28. And then, the cleaning member 23 passes through the nip section 32 formed between the pressure-contact roller 24 and the heating roller 21, and is stretched over the first guide roller 27 so as to be taken up by engaging a leading end thereof with the winding roller 26. When the leading end of the cleaning member 23 is taken up by the winding roller 26, tension is added to the cleaning member 23 by providing a brake function to the feeding roller 25.

In a state where the tension is added to the cleaning member 23, a take-up operation of the winding roller 26 is brought to a halt. In a state where the cleaning member 23 rests still, the heating roller 21 carries out rotary operation with the result that the surface of the heating roller 21 and the cleaning member 23 slidingly contact each other and then, the cleaning member 23 cleans the surface of the heating roller 21. When the developer 31*a* has been cleaned away to some extent, the winding roller 26 carries out a take-up operation for taking up the cleaning member 23. In other words, the winding roller 26 is intermittently rotated. At a time of the taking-up occasion due to this intermittent rotary drive, a distance in a circumferential direction in which the winding roller 26 rotationally moves, namely a travel distance of the cleaning member 23 is set to be equal to or longer than a circumference-wise distance Ln of the nip section 32 formed by pressing the pressure-contact roller 24 on the heating roller 21. The winding roller 26 thus takes up the cleaning member 23 at least longer than the distance Ln and by so doing, it is possible to reliably feed an unused portion of the cleaning member 23 to the nip section 32. Consequently, a cleaning performance by the cleaning member 23 can be reliably recovered on every take-up operation.

Subsequently, the above operations are repeated. Note that a timing that the winding roller 26 intermittently carries out the take-up operation will be described hereinafter.

Figure 3:
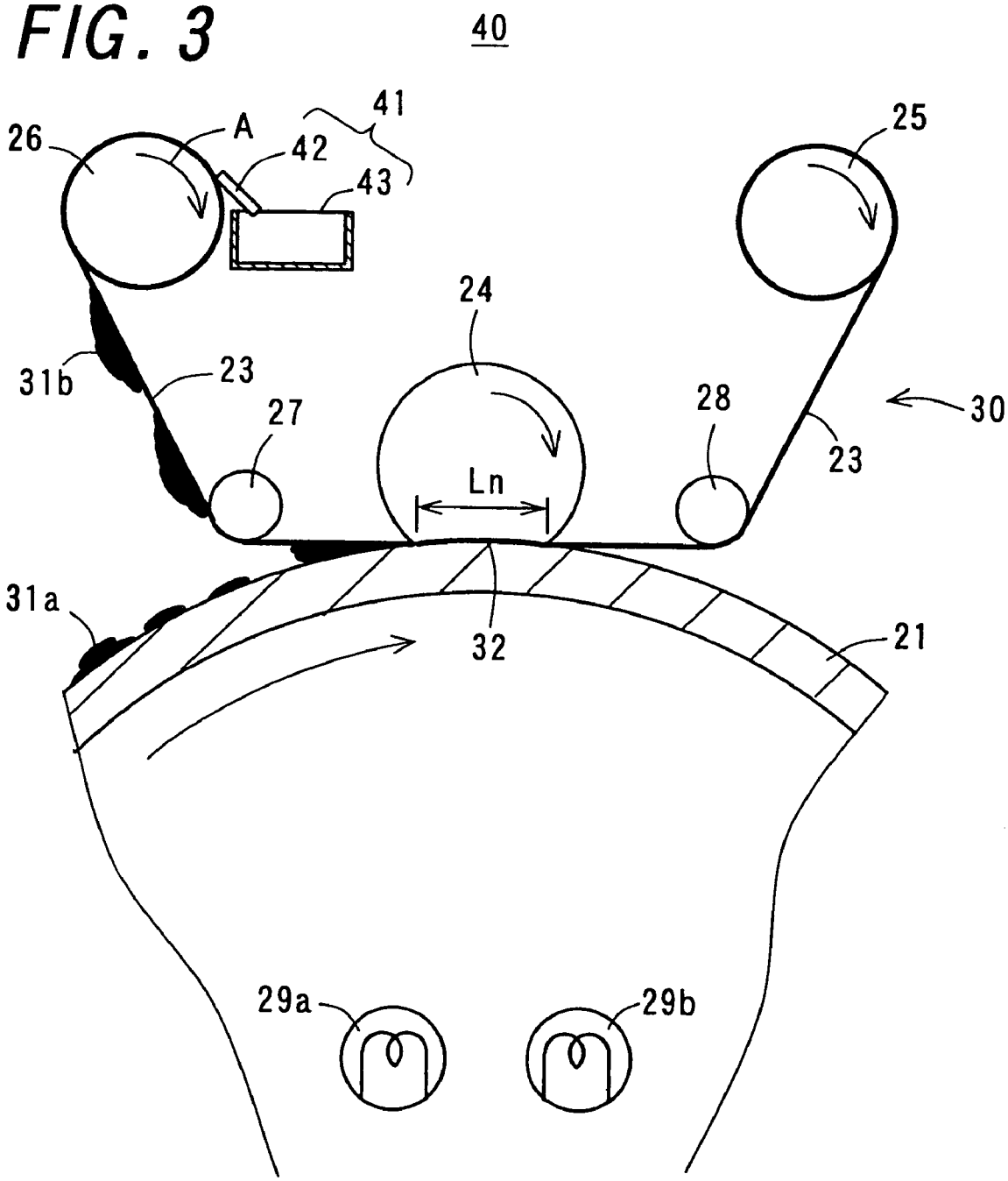
FIG. 3 is a schematic view showing a configuration of a fixing apparatus according to a second embodiment of the invention.

FIG. 3 is a schematic view showing a configuration of a fixing apparatus 40 according to a second embodiment of the invention. The fixing apparatus 40 according to the embodiment is similar to the fixing apparatus 20 according to the first embodiment of the invention, so that a corresponding component will be denoted by the same reference numeral and a description thereof will be omitted.

In the fixing apparatus 40, it should be noted that on a periphery of the winding roller 26 of the fixing roller cleaning means 30 is provided developer removing means 41 for removing the developer 31*b* existent on the surface of the to-be-taken-up cleaning member 23.

The developer removing means 41 comprises a blade member 42 provided so that an end thereof contacts the cleaning member 23 to be taken up by the winding roller 26, and a collection container 43 for collecting the developer removed from the surface of the cleaning member 23 by the blade member 42.

The blade member 42 is a platy member formed of metal, resin, or the like having elasticity, and extends in a direction of an axial line of the winding roller 26. One end of the blade member 42 in a direction perpendicular to the axial line contacts the cleaning member 23 to be taken up by the winding roller 26, and the other end thereof is mounted in a main body of the fixing apparatus 40. The collection container 43 is a hollow container having a schematic rectangular parallelepiped shape, in which an opening is formed over all sides. The collection container 43 is mounted in the main body of the fixing apparatus 40 in such a configuration that the developer removed from the surface of the cleaning member 23 by the blade member 42 is collected through the opening.

According to the fixing apparatus 40 of the embodiment, the developer 31*b* in a fused state, removed from the surface of the heating roller 21 (as well as the pressure roller 22) by the cleaning member 23 is easily solidified by the heat transfer loss to the first guide roller 27 since the cleaning member 23 is taken up in slidingly contact the first guide roller 27 at a time of being taken up by the winding roller 26. The developer removing means 41 cleans the developer 31*b* in a solidified state away from the cleaning member 23 and therefore, the removal can be carried out with extreme ease, and such a clean state that the cleaning member 23 is reusable can be made.

Consequently, the winding roller 26 can form a taken-up shape of the to-be-taken-up cleaning member 23 into a precise cylindrical shape. In other words, an installation of the developer removing means 41 can solve such a problem that the taken-up shape of the cleaning member 23 becomes irregular and a taken-up diameter varies depending on an attached amount of the developer 31*b*, caused by winding the developer 31*b* into the winding roller 26 when the cleaning member 23 is taken up without having the developer 31*b* removed from the surface thereof.

Furthermore, by taking up the finely cleaned cleaning member 23, it is made possible to easily obtain the taken-up diameter based on a take-up speed and a thickness of the cleaning member 23, with result that a rotational speed control of the winding roller 26 and the feeding roller 25 can be made easy.

For instance, it is assumed that the feeding roller 25 and the winding roller 26 have the same diameter, and a ratio of a diameter on the feeding roller 25-side on which the cleaning member 23 has been previously rolled up, to a diameter of the winding roller 26 is 2:1 in an initial state of the fixing roller cleaning means 30. In this regard, a ratio of the diameter of the feeding roller 25 to a diameter on the winding roller 26-side which has taken up the cleaning member 23 becomes 1:2 in a state where all the cleaning member 23 has been used and taken up by the winding roller 26. Accordingly, it is made possible to correctly calculate a ratio of the diameter on the winding roller 26-side to the diameter on the feeding roller 25-side in mid-course of the operation so that the rotational speed control can be made easy as described above.

In addition, by configuring the winding roller 26 and the feeding roller 25 so as to be capable of being reversibly rotated, in other words, be capable of being rotated in both the forward and reverse directions, it is possible to reuse the cleaning member 23 which has been cleaned and taken up. Note that developer removing means may be provided also on the feeding roller 25-side acting as a winding roller upon a reuse of the cleaning member 23, although an illustration of the developer removing means is omitted in FIG. 3. In this regard, the cleaning member 23 upon the reuse is also cleaned and taken up, with the result that the cleaning member 23 can be repeatedly used. Consequently, an exchange frequency of the cleaning member 23 can be reduced so as to decrease an intricacy of the operation, and a running cost can be reduced.

Figure 4:
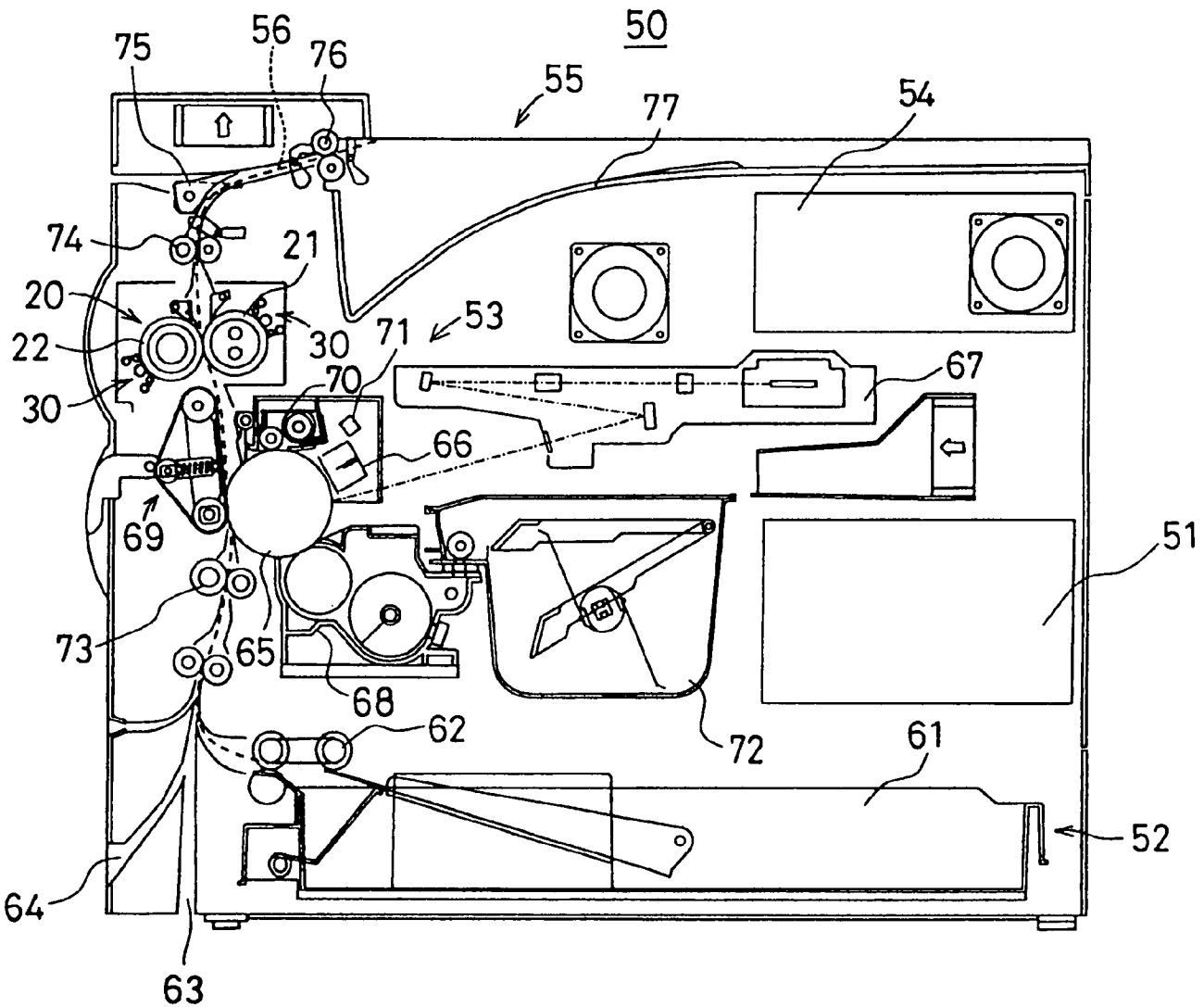
FIG. 4 is a schematic view showing a configuration of an image forming apparatus according to a third embodiment of the invention.

FIG. 4 is a schematic view showing a configuration of an image forming apparatus 50 according to a third embodiment of the invention. In the image forming apparatus 50 is provided the above-described fixing apparatus 20 according to the first embodiment of the invention. The image forming apparatus 50 illustrated in the embodiment is an electrophotographic printer.

The image forming apparatus 50 largely comprises a power source portion 51 for supplying electric power to various units of the image forming apparatus 50; a sheet supply portion 52 for supplying a recording paper serving as a recording medium on which an image is formed and recorded; a image forming unit 53; the fixing apparatus 20; a control portion 54 for receiving image information from an external equipment and controlling a whole operation of the image forming apparatus 50; a discharge portion 55; and a sheet conveying system 56 for controlling conveyance of a recording paper from the sheet supply portion 52 to the discharge portion 55.

The sheet supply portion 52 is provided with a supply tray 61 for housing a recording paper, and a pickup roller 62 for feeding the recording paper housed in the supply tray 61 sheet by sheet to the sheet conveying system 56. Note that under the sheet supply portion 52 and under a main body of the image forming apparatus, a sheet supply portion including a multi-stage sheet tray, a high-capacity sheet supply portion capable of housing sheets in large quantity, or the like may be disposed as a peripheral equipment. In a case where such a peripheral equipment is provided, the recording paper from the peripheral equipment is supplied from a sheet receiving portion 63 and an expansive sheet receiving portion 64 to the main body of the image forming apparatus.

The image forming unit 53 is disposed above the sheet supply unit 52. The image forming unit 53 comprises a photoreceptor 65, and a charging unit 66, a light scanning unit 67, a developing unit 68, a transfer unit 69, a cleaning unit 70, and an electricity removing lamp 71, which are disposed along an outer circumferential surface of the photoreceptor 65.

The charging unit 66 uniformly charges a surface of the photoreceptor 65 which has not yet been exposed to light by the light scanning unit 67. The light scanning unit 67 scans the uniformly charged photoreceptor 65 with light in accordance with the image information so as to form an electrostatic latent image. The developing unit 68 supplies the developer inside a developer supply container 72 to the electrostatic latent image formed on the surface of the photoreceptor 65 so as to form a visualized developer image.

The transfer unit 69 transfers the developer image on the recording paper which is supplied in arranged timing so that a registration roller 73 provided upstream of the photoreceptor 65 in the sheet conveying system 56 registers the recording paper at a developer image forming position on the photoreceptor 65.

The cleaning unit 70 removes a residual developer which has not been transferred on the recording paper and remains on the photoreceptor 65. The electricity removing lamp 71 removes charges on the surface of the photoreceptor 65, thereby preparing for next uniform charging of the charging unit 66.

The fixing apparatus 20 is provided downstream of the transfer unit 69 in the sheet conveying system 56 so that the developer image transferred on the recording paper is fixed so as to form a solid recording image.

A conveyance roller 74 and a switching gate 75 are disposed further downstream of the fixing apparatus 20 in the sheet conveying system 56. The conveyance roller 74 conveys the recording paper which has passed through the fixing apparatus 20, to further downstream in the sheet conveying system 56. The switching gate 75 optionally opens a conveyance path which is suitable for the recording paper to be conveyed by the conveyance roller 74, to be conveyed. The discharge portion 55 comprises a discharge roller 76 provided further downstream of the switching gate 75 in the sheet conveying system 56, and a discharge tray 77 for placing the recording paper discharged outward the main body of the image forming apparatus by the discharge roller 76.

The control portion 54 is a process circuit having a central processing unit (CPU), for instance. The control portion 54 has accessories such as a memory serving as storing means and an interface for receiving image information from an external equipment. The control portion 54 controls a whole operation of the image forming apparatus 50, and to-be-controlled objects thereof include the fixing apparatus 20. The memory of the control portion 54 previously stores a program and an operational control condition for controlling the whole operation of the image forming apparatus 50.

An image forming operation in the image forming apparatus 50 will be described hereinafter. For instance, image information produced by external equipments such as a personal computer is given to the control portion 54 via the interface and then, the image information is stored in the memory of the control portion 54. The control portion 54 reads out the image information from the memory and performs image processing such as conversion process. And then, the control portion 54 feeds to the light scanning unit 67 the image information on which the image processing is performed. The light scanning unit 67 irradiates the surface of the photoreceptor 65, which has been charged by the charging unit 66 so as to have a uniform electric potential, with light in accordance with the image information so as to form an electrostatic latent image.

The electrostatic latent image formed on the surface of the photoreceptor 65 is developed by the developing unit 68 so as to be a developer image. The transfer unit 69 transfers the developer image formed on the photoreceptor 65 onto the recording paper which has been supplied from the sheet supply portion 52 and fed in arranged timing by the registration roller 73. The recording paper on which the developer image has been transferred, is fixed by the fixing apparatus 20 and then discharged to the discharge tray 77 by the discharge roller 76.

On the other hand, the photoreceptor 65 from which the developer image is detached by the transfer unit 69, has the residual developer cleaned by the cleaning unit 70 and the electricity removed by the electricity removing lamp 71. The image forming apparatus 50 can repeat the aforementioned image forming operation.

The fixing apparatus 20 mounted on the image forming apparatus 50 operates so that the developer on the recording paper is made to be fused and softened so as to be fixed on the recording paper. However, the developer is attached to the fixing roller by repeating a fixing operation on a plurality of the recording papers and therefore, the fixing roller is cleaned by the cleaning member 23 of the fixing roller cleaning means 30 as described above. Furthermore, attributable to the cleaning, in a gap between the cleaning member 23 and the fixing roller is accumulated to some extent the developer removed from the fixing roller and then, the winding roller 26 is made to be rotated in a forward rotating direction (an arrow sign A direction in FIG. 2) so as to take up the cleaning member 23 by a certain length so that a clean portion of the cleaning member 23 is newly made to slidingly contact the fixing roller. By so doing, the cleaning member 23 is made to recover a cleaning capability thereof so as to continue to clean the fixing roller. In other words, an operation of the winding roller 26 is an intermittent rotary operation.

A timing that this winding roller 26 starts the intermittent rotary operation, namely carries out the take-up operation intermittently, depends on an amount of the developer accumulating in the gap between the cleaning member 23 and the fixing roller. Since the amount of the accumulating developer is substantially proportional to an amount of the developer on the recording paper which passes through the fixing apparatus 20 and is fixed, the amount of the accumulating developer can be obtained by a size of the recording paper and a print ratio with respect to the recording paper.

Consequently, in the image forming apparatus 50 in which the fixing apparatus 20 is mounted, the timing of taking up the cleaning member 23 of the fixing apparatus 20 is determined by the size of the recording paper and the print ratio with respect to the recording paper as indexes so that the winding roller 26 (when the cleaning member 23 is reversely fed, the feeding roller 25) is made to operate.

Figure 5:
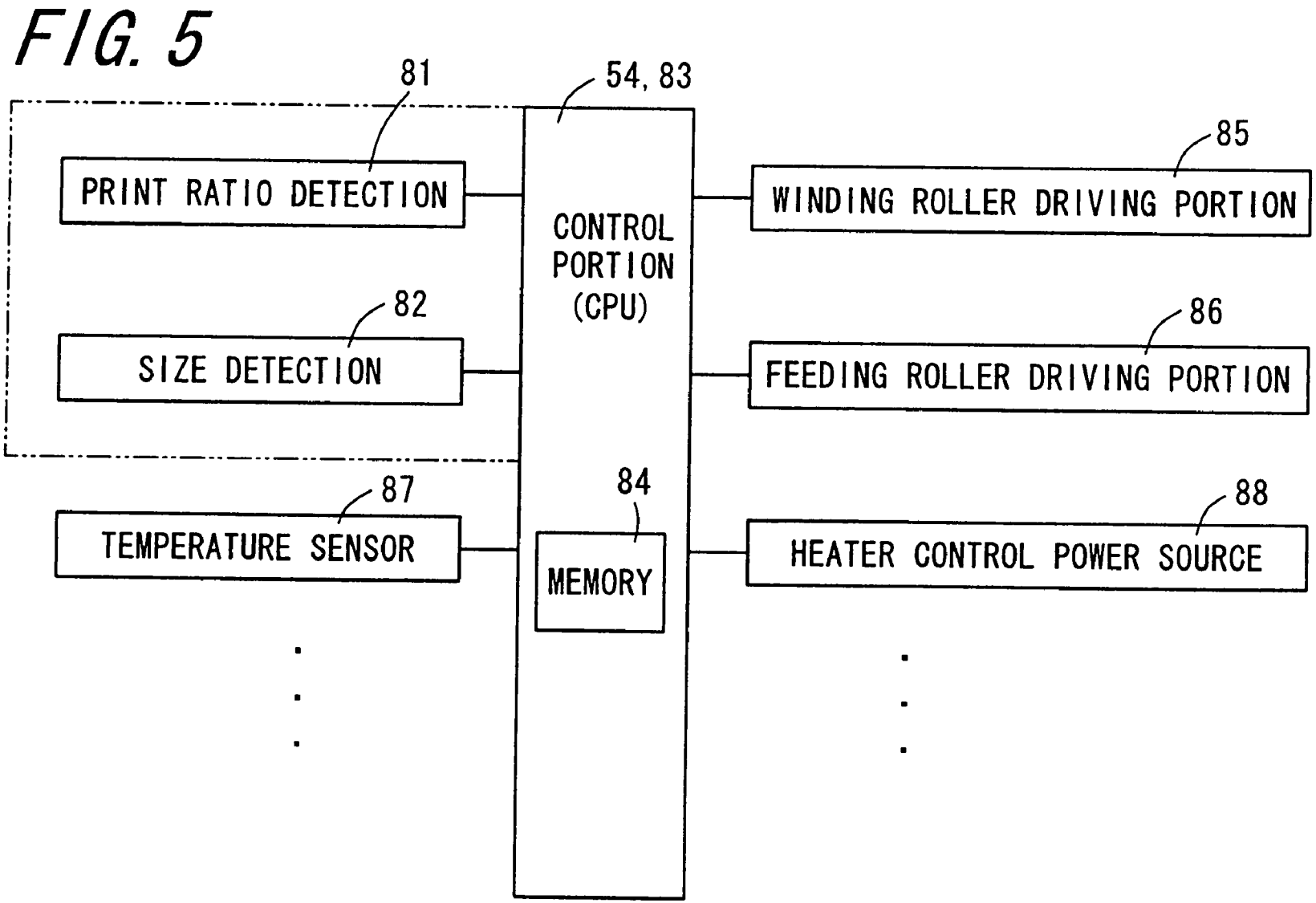
FIG. 5 is a block diagram showing an electrical structure according to an operation of a fixing apparatus in an image forming apparatus.
Figure 9:
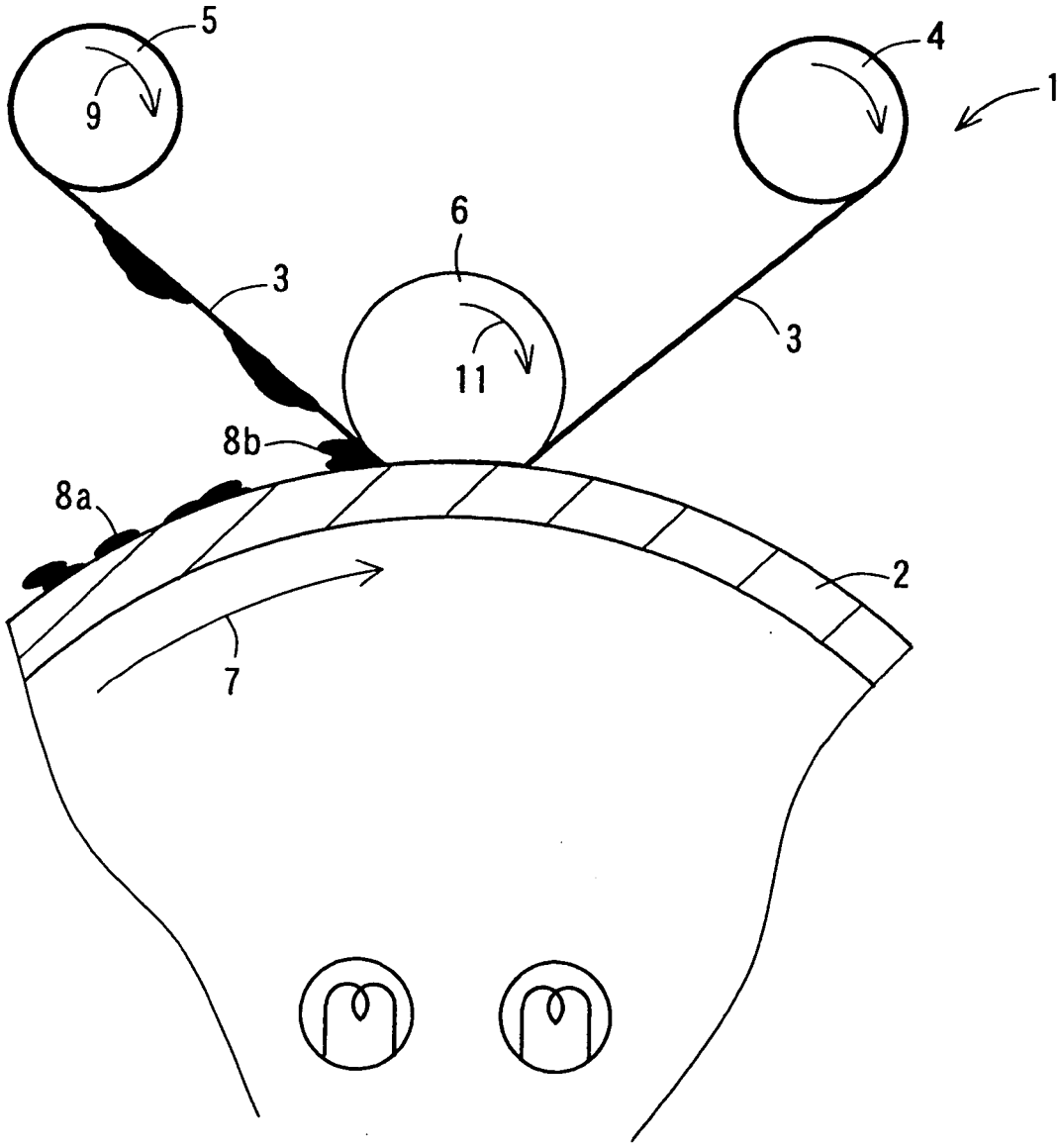
FIG. 9 PRIOR ART
FIG. 9 is a schematic view showing a configuration of roller cleaning means provided in a related art fixing apparatus.
Figure 10A:
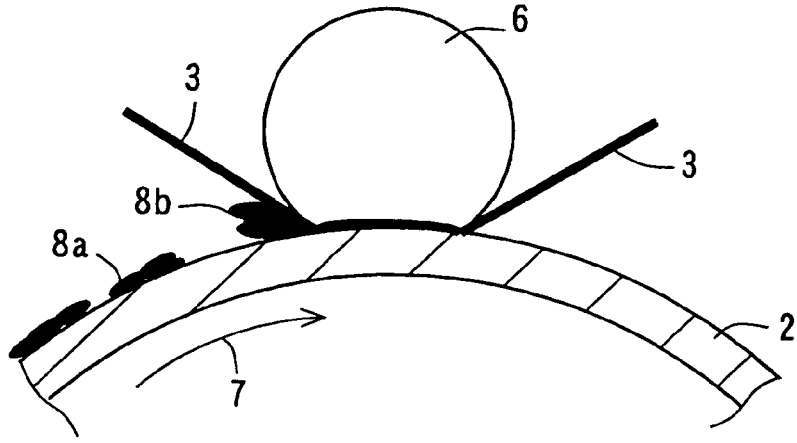
FIG. 10A PRIOR ART
FIGS. 10A to 10C are views for explaining an operational outline of the roller cleaning means shown in FIG. 9.
Figure 10B:
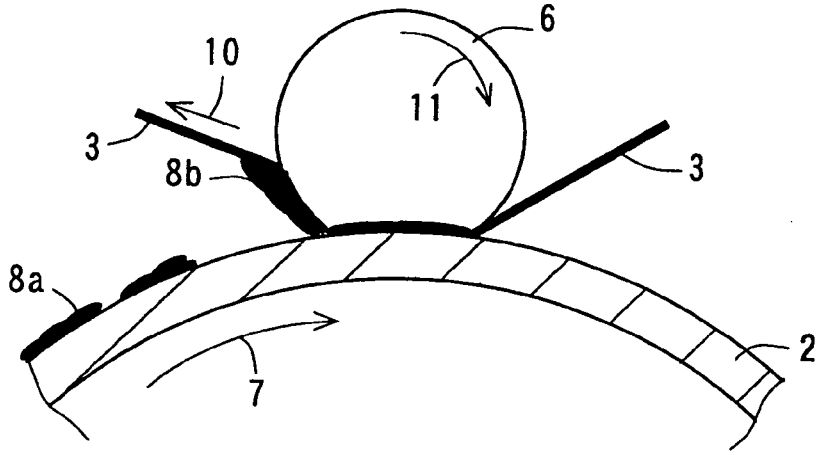
FIG. 10B PRIOR ART
Figure 10C:
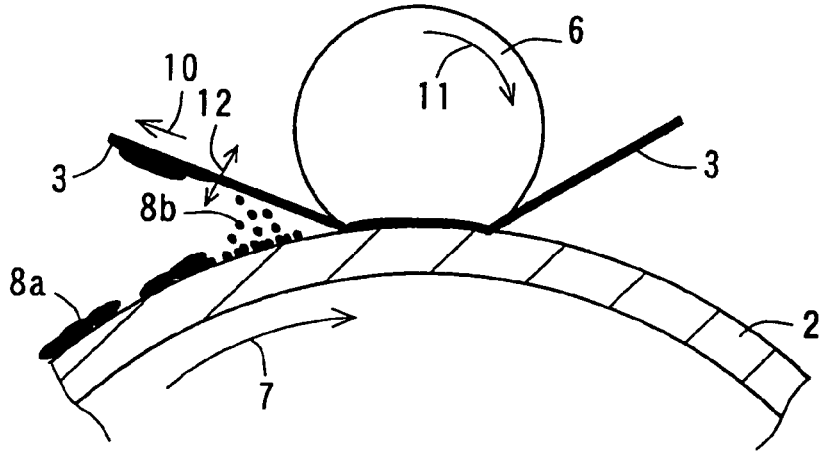
FIG. 10C PRIOR ART

FIG. 5 is a block diagram showing an electrical structure according to an operation of the fixing apparatus in the image forming apparatus 50. The image forming apparatus 50 provided with the fixing apparatus 20, comprises print ratio detecting means 81 for detecting the print ratio of to-be-formed print image, size detecting means 82 for detecting the size of the recording paper on which the print image is recorded, and rotary launch control means 83 for responding to detected outputs of the print ratio detecting means 81 and the size detecting means 82, and for controlling a timing of starting a rotary operation of intermittent rotation of the winding roller 21 and feeding roller 22 of the fixing apparatus 20. In the image forming apparatus 50, the take-up operation of the winding roller 26 starts to carry out by a control command of the rotary launch control means 83. Note that to the control portion 54 are connected various input systems and output systems other than various units shown in FIG. 5 for operating the image forming apparatus 50, but these systems are omitted in order to avoid intricacy of the drawing.

In the image forming apparatus 50, since the image information is given to the control portion 54 as digital data from external equipments such as a personal computer, for instance, and the print ratio of the image is included in the image information, the control portion 54 which has received the image information can detect the print ratio of the image information. Accordingly, in the embodiment, the control portion 54 serves as well as the print ratio detecting means 81.

In addition, when the image information together with the print command is given from the personal computer to the control portion 54, the information according to the print command includes the size of the recording paper on which an image should be formed. Consequently, the size of the recording paper can be detected likewise by the control portion 54. Moreover, when the image information once stored in the memory 84 of the control portion 54 is read out on the image forming apparatus 50-side so as to form an image, for instance when an operator inputs a print request from an operating portion of the image forming apparatus 50 so as to form an image, the to-be-inputted print request information includes the size of the recording paper and therefore, the control portion 54 for receiving the print request information can detect the size of the recording paper. Accordingly, in the embodiment, the control portion 54 serves as well as the size detecting means 82.

On the basis of the print ratio of the image information and the size of the recording paper on which an image should be formed, being detected by the print ratio detecting means 81 and the size detecting means 82 as which the control portion 54 serves as well, the control portion 54 serving as well as the rotary launch control means 83 determines the timing of starting the rotary operation of the winding roller 26, and outputs a command for the take-up operation with respect to a winding roller driving portion 85 for driving the winding roller 26, or a feeding roller driving portion 86 for driving the feeding roller 25.

Note that the electrical structure according to the operation of the fixing apparatus in the image forming apparatus 50 includes a temperature sensor 87 provided on the fixing roller, and a heater control power source 88 for turning on/off an electric power supply with respect to the heating heaters 29*a* and 29*b* of the heating roller 21. A detected result of a temperature of the fixing roller due to the temperature sensor 87 is inputted to the control portion 54 so that the control portion 54 controls an operation of the heater control power source 88, thereby setting the temperature of the fixing roller to a desired temperature.

Hereinafter, there is illustrated a method of determining the timing of starting the rotary operation due to the control portion 54 serving as the rotary launch control means 83. In the image forming apparatus 50 of the embodiment, the timing of starting the rotary operation of the winding roller 26 is determined by the print ratio and the size of the recording paper to be printed at the print ratio as indexes.

As described above, the developer amount accumulating on the cleaning member 23 which is in contact with the fixing roller is substantially proportional to the developer amount on the recording paper which passes through the fixing apparatus 20 and is fixed. Accordingly, in a case where the size of the recording paper is the same, the developer is accumulated faster with a higher print ratio. Moreover, in a case where the print ratio is the same, the developer is accumulated faster with a larger recording paper.

Consequently, the size of the recording paper and the print ratio with respect to the recording paper are multiplied by a coefficient for weighting, and converted to a case of being printed on the recording paper of a standard size at a standard print ratio, with the result that the obtained value can be recognized as an index in order to know an accumulated amount of the developer, in other words, a soiling degree of the cleaning member 23. This index value is accumulated, and when this integrated value exceeds a predetermined standard value as a cleaning limitation of the cleaning member 23, a clean portion of the cleaning member 23 can be newly made to contact the fixing roller so as to recover a cleaning ability by taking up the cleaning member 23.

In the image forming apparatus 50, in the memory 84 provided in the control portion 54 is previously stored a table data for converting the size of the recording paper and the print ratio with respect to the recording paper to the case of being printed on the recording paper of the standard size at the standard print ratio. The control portion 54 serving as the rotary launch control means 83 responds to the size of the recording paper detected by the size detecting means 82 and the print ratio detected by the print ratio detecting means 81, and obtain a standard index value based on the aforementioned table data. Sequentially, the control portion 54 obtains an integrated value by accumulating the standard index value and furthermore, compares the integrated value to a predetermined standard value. When the integrated value becomes equal to or more than the standard value, the control portion 54 outputs an operational command to the winding roller driving portion 85 (when being reversely taken up, the feeding roller driving portion 86) so as to take up the cleaning member 23 by an only predetermined length.

FIGS. 6 and 7 are views illustrating table data for converting the size of the recording paper and the print ratio to the standard index value. In the image forming apparatus 50 of the embodiment is standardized on a case where a paper of A4 size prescribed in Japanese Industrial Standards (JIS) P0138 is widthwise conveyed and fixed.

In FIG. 6 is shown a conversion ratio for converting the prints on papers of various sizes to a case of an A4 size widthwise conveyance serving as a standard index. In FIG. 7 is shown a conversion ratio for converting the converted value to the A4 size widthwise conveyance, to a case of a print ratio of 5% or less to be selected as a standard, further in the A4 size widthwise conveyance.

A calculation of the integrated value in the control portion 54 will be illustrated hereinbelow. For instance, when the recording paper just passing through the fixing apparatus 20 has a print ratio of 8 to 12% in a size A3, this is converted to the standard index value which is a print ratio of 5% or less in the A4 size widthwise conveyance. First, a paper of A3 size is converted to two sheets of the recording paper of the print ratio of 8 to 12% in the A4 widthwise conveyance by accumulating the conversion rate 2.00 based on the table data in FIG. 6. Next, the print ratio of 8 to 12% in the A4 widthwise conveyance is converted to four sheets of the recording paper by accumulating the conversion rate 2.00 for converting to the print ratio of 5% or less in the A4 widthwise conveyance based on the table data in FIG. 7. Thus, when one sheet of the recording paper of the print ratio of 8 to 12% in the A3 is fixed, the recording paper is converted to the four sheets of the recording paper of the print ratio of 5% or less in the A4 widthwise conveyance serving as the standard index value.

Thus, every time one sheet of the recording paper is fixed by the fixing apparatus 20, the control portion 54 converts the recording paper to the standard index value and performs a calculation of accumulating the converted value so as to obtain the integrated value. When this integrated value becomes the standard value or more, the control portion 54 outputs the operational command so that the winding roller driving portion 85 (when being reversely taken up, the feeding roller driving portion 86) carries out the take-up operation of the cleaning member 23.

FIG. 8 is a flow chart for explaining the take-up operation of the cleaning member 23. With reference to the FIG. 8, the take-up operation of the cleaning member 23 will be described.

A start of step s0 is a state where, for instance, image information previously created by a personal computer or the like is given to the image forming apparatus 50, and stored in the memory 84 of the control portion 54 in the image forming apparatus, and then the print request is inputted to the image forming apparatus 50 with the result that image read out from the memory 84 can be printed and fixed.

At step s1, a main power of the image forming apparatus 50 is turned on by the operator. At step s2, the control portion 54 initializes the image forming apparatus 50. Here, the initialization of the image forming apparatus 50 indicates a set of preliminary operation for the image forming apparatus 50 to perform image formation. The preliminary operation includes removal of residual potential of the photoreceptor 65, temperature rising of the fixing roller up to a prescribed temperature, and the like. At step s3, a print request is inputted by the operator from an input portion provided in the image forming apparatus 50. This print request includes a designation of the to-be-printed image information among the image information stored inside the memory 84, a designation of the size of the recording paper for recording the image information, and the number of printing sheets.

At step s4, the control portion 54 reads out from the memory 84 a standard value (X) which is predetermined as a cleaning limitation of the cleaning member 23 and previously stored in the memory 84, and an integrated value (Y1) obtained by accumulating the value which is obtained by converting to the standard index value during a previous print operation. At step s5, in response to the designation of the to-be-printed image information and the designation of the size of the recording paper for recording the image information, the control portion 54 serving as well as the print ratio detecting means 81 and the size detecting means 82, detects the print ratio from the designated image information, and detects the size of the recording paper. Further, the control portion 54 responds to the detected print ratio and recording paper size, so as to calculate the standard index value (Yr) which is converted to A4 widthwise conveyance and the print request 5% or less regarding the to-be-printed image information based on the table data shown in FIGS. 6 and 7.

At step s6, a print process is executed in the image forming unit 53 of the image forming apparatus 50, and a fixing process is executed in the fixing apparatus 20. At step s7, the control portion 54 obtains the integrated value (Y2) by adding the standard index value (Yr) to the integrated value (Y1) ((Y2)=(Y1)+(Yr)).

At step s8, the control portion 54 compares the integrated value (Y2) and the standard value (X). When the integrated value (Y2) is equal to or more than the standard value (X), the operation proceeds to step s9. When the integrated value (Y2) is less than the standard value (X), the operation proceeds to step s11.

At step s9, the integrated value (Y2) is equal to or more than the standard value (X) predetermined as the cleaning limitation and therefore, the control portion 54 outputs the operational command to the winding roller driving portion 85 so that the winding roller driving portion 85 rotationally drives the winding roller 26 in the forward rotating direction A for a predetermined time. Here, the predetermined time that the winding roller 26 is rotated is set to a time that the winding roller 26 can take up the cleaning member 23 by only a distance which is equal to or longer than a circumference-wise distance Ln of the nip section 32 formed by the heating roller 21 and the pressure-contact roller 24. Note that the predetermined time is preferably set so as to become shorter in response to an increase of the taken-up diameter of the winding roller 26 since the taken-up diameter of the winding roller 26 becomes larger as the fixing operation makes progress and the cleaning member 23 is taken up more. At step s10, since the cleaning member 23 has been taken up so as to be in a state of capable of cleaning with the clean portion, the control portion 54 initializes the integrated value (Y2) (in the embodiment, to zero sheet) which can be also called as an index for the soiling degree of the cleaning member 23.

At step s11 is determined whether there is next print process or not. This determination is conducted by the control portion 54. Since the previous print request includes the information of the number of the printing sheets, the control portion 54 can determine whether there is next printing or not by counting the number of times of the print process. When there is no next print process, the operation proceeds to step s12 and when there is a next print process, the operation returns to the step s6 and the subsequent steps are repeated. At step s12, the integrated value (Y2) is replaced by the integrated value (Y1) and stored in the memory 84, and then the operation proceeds to End of step s13.

At the End of step s13, the main power of the image forming apparatus 50 can be turned off so as to end the image forming operation. In this case, a next image forming operation resumes from the step s1. Moreover, at the End of step s13, it is also possible to bring a standby state that the print process is not operated, but neither is the main power turned off. In this case, the next image forming operation resumes from the print request at step s3.

As described above, the image forming apparatus 50 of the embodiment is configured so as to comprise the fixing apparatus 20. However, without being limited to this configuration, the image forming apparatus may be configured so as to comprise the fixing apparatus 40 having the developer removing means 41.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A fixing apparatus for fusing and fixing an unfixed developer onto a recording medium, comprising:

fixing rollers which form a pair of rotators, a recording medium on which an image of an unfixed developer is formed being passed through a pressure contact section formed by the fixing rollers;

a belt-shaped cleaning member provided so as to contact at least either one of fixing rollers, for cleaning a surface of the fixing roller;

a pressure-contact roller provided so as to press the cleaning member on the fixing roller which is in contact with the cleaning member;

a feeding roller for feeding the belt-shaped cleaning member which has been previously rolled up;

a winding roller for taking up the cleaning member which has been fed from the feeding roller and cleaned the surface of the fixing roller;

a guide roller provided between the pressure-contact roller and the winding roller so as to contact the cleaning member; and developer removing means for removing a developer existent on a surface of the to-be-taken-up cleaning member provided on a periphery of the winding roller.

2. The fixing apparatus of claim 1, wherein the cleaning member, the pressure-contact roller, the feeding roller, the winding roller, the guide roller and the developer removing means are provided for each of the fixing rollers.

3. The fixing apparatus of claim 1, wherein the cleaning member is provided so as to extend in a tangential direction with respect to an outer circumferential surface of the fixing roller which is in contact therewith.

4. The fixing apparatus of claim 1, wherein the guide roller has a portion made of metal which contacts at least the cleaning member.

5. The fixing apparatus of claim 1, wherein each of the winding roller and the feeding roller can be rotated in both forward and reverse directions.

6. The fixing apparatus of claim 1, wherein the winding roller is intermittently rotated, and a distance in a circumferential direction in which the winding roller rotationally moves at one occasion, is equal to or longer than a circumference-wise distance of the pressure contact region formed by pressing the pressure-contact roller on at least either one of fixing rollers.

7. An image forming apparatus for forming a print image in electrophotography, comprising the fixing apparatus of claim 1.

8. The image forming apparatus of claim 7, further comprising:

print ratio detecting means for detecting print ratio of a to-be-formed print image;

size detecting means for detecting a size of the recording medium on which the print image is recorded; and control means for responding to detected outputs of the print ratio detecting means and the size detecting means, and for controlling a timing of starting a rotary operation of intermittent rotation of the winding roller and feeding roller of the fixing apparatus.

9. The image forming apparatus of claim 8, wherein an intermittent time of the intermittent rotation becomes shorter along with increasing print ratio or increasing size of the recording medium.

* * * * *